United States Patent [19]

Hanson

[11] Patent Number: 4,493,640

[45] Date of Patent: Jan. 15, 1985

[54] SOLVENT REDUCING OVEN

[75] Inventor: Lester A. Hanson, Parma, Mich.

[73] Assignee: Blu-Surf, Inc., Parma, Mich.

[21] Appl. No.: 544,203

[22] Filed: Oct. 21, 1983

[51] Int. Cl.[3] ..... F27B 9/28; F24H 1/00

[52] U.S. Cl. ..... 432/72; 432/59; 432/222

[58] Field of Search ..... 432/8, 59, 72, 222

[56] References Cited

U.S. PATENT DOCUMENTS

| | | | |
|---|---|---|---|
| 3,358,979 | 12/1967 | Flynn | |
| 3,744,963 | 7/1973 | Flynn | 432/59 |
| 4,115,052 | 9/1978 | Flynn | 432/72 |
| 4,133,636 | 1/1979 | Flynn | 432/222 |
| 4,191,527 | 3/1980 | Trouillard | 432/72 |

*Primary Examiner*—John J. Camby

*Attorney, Agent, or Firm*—Price, Heneveld, Huizenga & Cooper

[57] ABSTRACT

A solvent reducing oven wherein stock that includes solvent is conveyed through an oven housing from which the solvent vapors are ducted and propelled into the side of the burner at an acute angle of about 60 degrees plus or minus 5 degrees to the burner axis. The solvent vapors are thereby combusted and the heated gases resulting being mixed with regulated quantities of air and propelled back into the oven for further solvent evaporation.

6 Claims, 4 Drawing Figures

SOLVENT REDUCING OVEN

BACKGROUND OF THE INVENTION

This invention relates to an oven for treating web stock or flat stock, especially wood, metal or pressed board coated with adhesive, glue, protective coatings or the like containing a high concentration of solvents, by means of special gaseous combustion and recycling.

In the typical treatment of various coated products and in the laminating manufacture of multiple layered products, a continuous product or lamination is passed through a conveyorized oven or heated chamber for solvent removal with drying. Heated gases are forced over the product in substantial volumes for evaporation of the solvent. During this process, the temperature of the gases is limited to a prescribed maximum for safety reasons, and to avoid damage to the coating or substrate. Consequently, it is typically necessary to have several heater sections in series to achieve effective drying. Such equipment requires substantial capital outlay, space and heat input. A great share of the generated heat is exhausted into the atmosphere and lost within the volumes of gases discharged. These gases are laden with varying and often excessive amounts of organic solvents driven off the product in the pre-dry, flash-off or first zone of the oven. These solvents are carried by means of the oven exhaust systems into the atmosphere. This of course is not ecologically desirable. It is recognized in the trade that present drying equipment, though effective, is expensive and space consuming to the user while the public in general is encumbered with higher fuel costs and finished product cost due to the tremendous quantities of fuel necessary to operate. The public also has the ecological disadvantage of undesirable stack discharge.

SUMMARY OF THE INVENTION

The present invention effectuates more efficient and rapid drying of flat stock, particularly glued laminates, in an oven using less fuel and less equipment, while resulting in ecologically improved controlled stack discharge. Using this invention, organic solvents are removed from the discharge air stream, reducing fuel consumption and curbing pollutioncausing stack discharge. With the flow circuit and apparatus of the invention, the solvents and pollutants are combusted in a special chamber, at a relatively higher temperature, the resulting gases being subsequently cooled with supplemental fresh air, and used to provide needed heat for the drying process. This process takes advantage of the exothermic heat given off during the incineration of the solvents. An advantageous feature of the invention is its adaptability to existing equipment, and more specifically to existing process lines, if desired. The mentioned apparatus, being smaller in size and shorter in length than prior art, allows replacement integration into existing process lines without expensive rework or relocation. This invention renders available to users the capacity to control stack discharge for curbing air pollution of combustible materials to meet pollution standards; yet the amount of equipment is lessened over that previously required rather than increased as might be expected. Experimental operation on a trial basis under actual conditions establishes that the invention enables fuel conservation, increased production rates, less equipment to equal present production rates, and curbed stack output for pollution control.

Because the invention was conceived and developed for drying and heat treating glues, adhesives and coatings on flat laminate stock, and is particularly useful for such, it will be described herein chiefly in this context. However, it is known that the concept in its broader aspects could be adapted to heat treatment of other materials where combustible pollutants are driven off the stock, e.g. paper, wood, metal, plastics and the like.

DESCRIPTION OF THE PREFERRED EMBODIMENT

Figure 1:
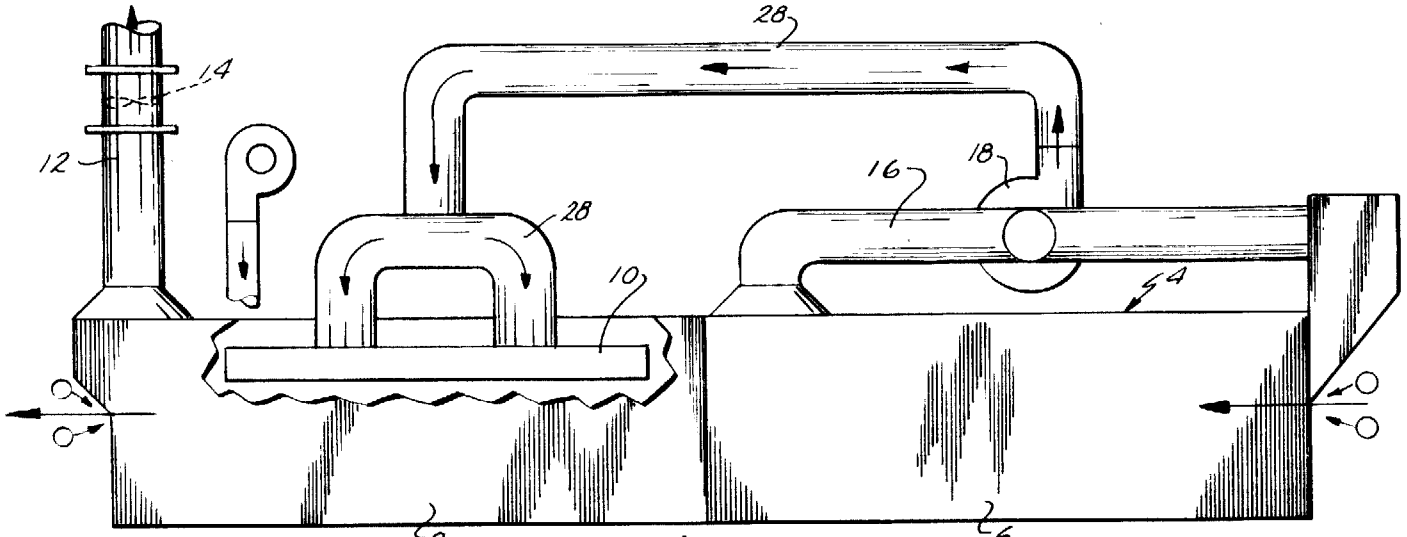
FIG. 1 is a side elevational view of a two zone oven apparatus employing the invention.

Referring now specifically to the drawings, in FIG. 1 is depicted an illustrative assembly of the novel apparatus 4 including a multiple oven subassembly 6 and 8, incinerator burner 10, exhaust stack unit 12, exhaust fan 14 and a cooperative system of ducting 16 including an air propelling blower unit 18.

Oven 4 is shown to include an entry section at one end, sometimes referred to as the flash-off section indicated at 6, and an exit section at the opposite end indicated herein as 8. The specific number of oven sections could vary to suit particular usage, to include a plurality of intermediate sections therebetween. The flat stock or work advances progressively as indicated by the arrows in the drawings, usually by conveyor means C (FIG. 4), moving sequentially into and through the first section, then successively through the remaining sections until exiting from section 8.

Process recycle duct unit 16 with its particular blower and motor unit 18 are at or near the entry section, while exhaust stack unit 12 with its blower and motor unit 14 are at the exit section. The special gaseous flow character of the apparatus removes the necessity of having an exhaust stack at each of any intermediate oven sections, and in fact even the exhaust through stack 12 constitutes a mixture of ambient air and combustion product gases generally free of combustible gases, presenting definite non-polluting advantages.

The work material as introduced into the oven possesses volatile combustible substances such as solvents, oils and other organic compounds. The present invention was conceived chiefly for the purpose of drying and heat treating of laminated board stock. It is particularly useful for this purpose. Manufacturers of this type of product have established that temperatures of 350 degrees F. should not be exceeded during drying, to avoid damage and discoloration of the finished product.

In the depicted illustrative version of the invention, each zone is preferably of a length of about twenty (20) feet. Each has a housing of generally rectangular cross section, suitably lined with insulation and sealed against the adjacent housing to prevent leakage. These collectively form an elongated internal chamber extending from the inlet to the outlet. In each oven section, the flat board stock that passes through the chamber is straddled above and below by a series of hot gas manifold pipes which project laterally, i.e. transversely of the stock direction of travel. From orifices of these manifold pipes, hot gases are ejected both downwardly and upwardly onto the passing work stock.

Figure 2:
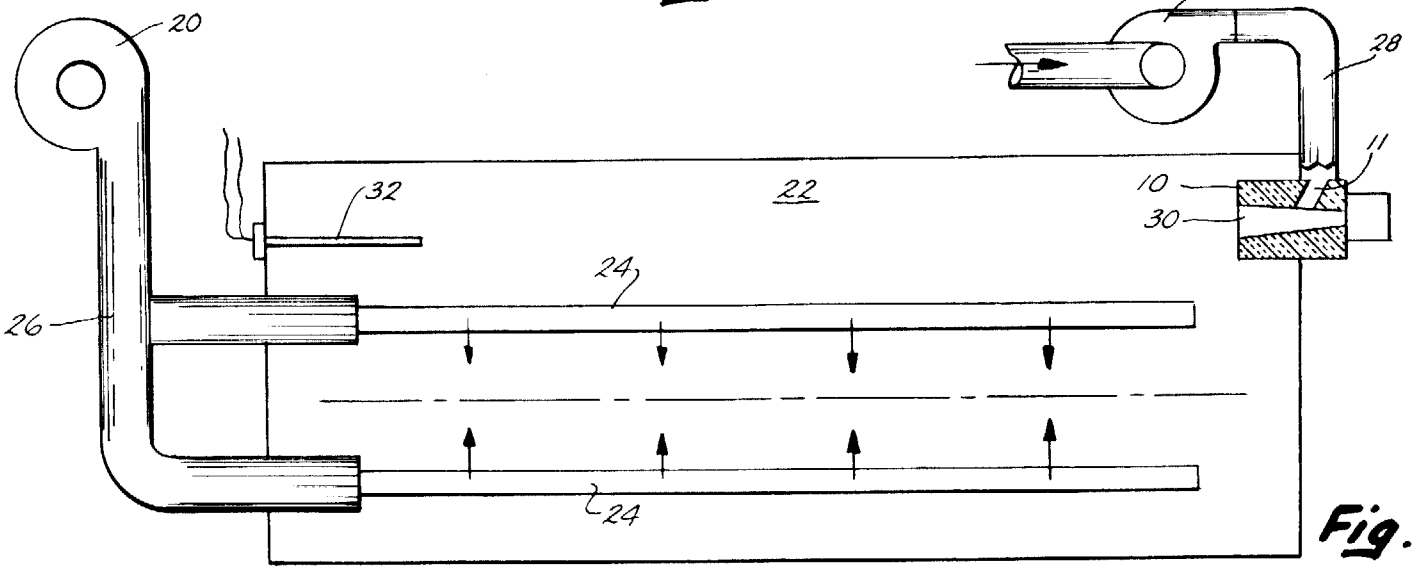
FIG. 2 is an end elevational view of the input end of the apparatus in FIG. 1.
Figure 4:
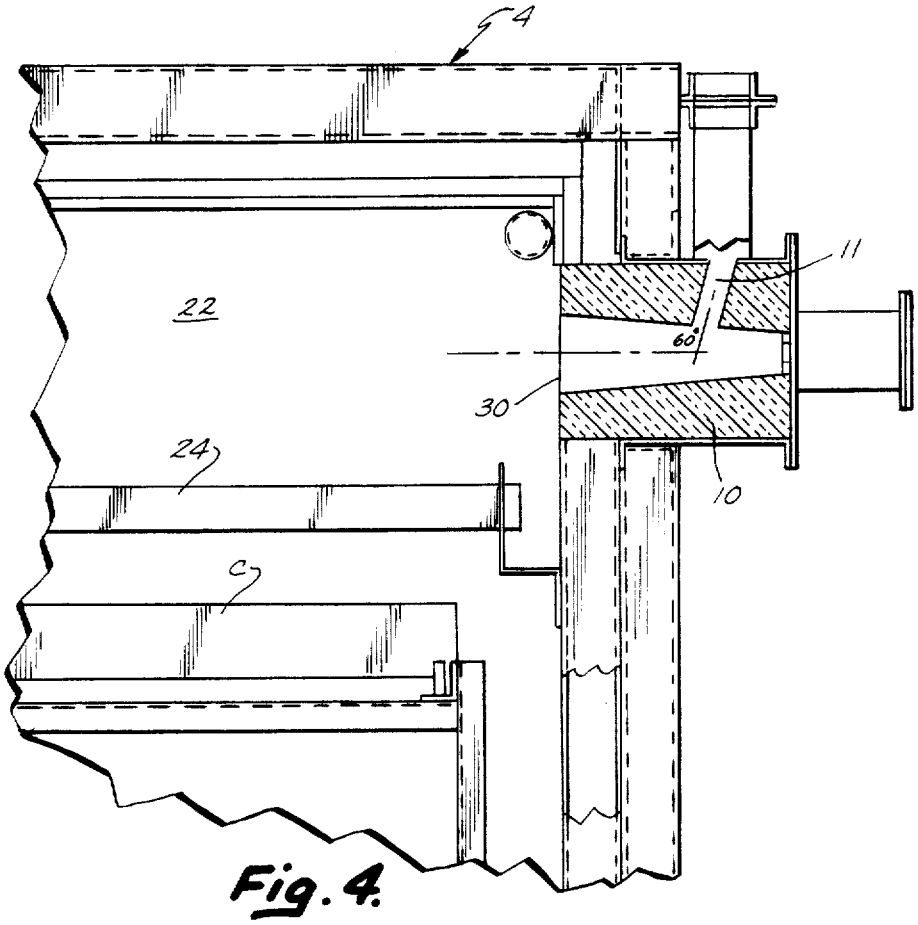
FIG. 4 is a sectional view of the elongated burner combustion chamber.
Figure 3:
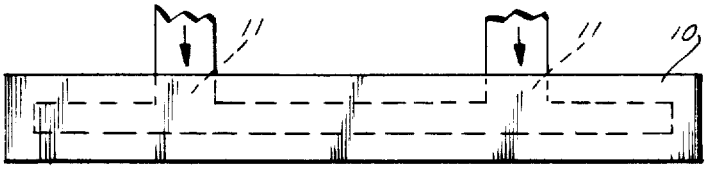
FIG. 3 is a fragmentary, side elevational view of the section in FIG. 2.

Manifolds 26 for pipes 24 (FIG. 2) are in flow communication with input ducts. The manifolds for the entry section 6 are arranged to receive ambient air. This air discharge entrains heat escaping from section 8 and impinges on and around the work stock as it progressively moves through the oven section. Volatiles are thus driven off the work in this preheat or flash-off oven section, collected in the ductwork 16 (FIGS. 1 and 2), and propelled by the blower fan and motor 18 through manifold ductwork 28 under slight pressure to a series of special passages 11 within an elongated unique barrier nozzle 10 extending lengthwise of the oven. Assembly 10 is preferably of the type set forth at FIGS. 3 and 4 and described in column 6, second form of U.S. Pat. No. 3,436,065 along with FIG. 3, and also at 38 in U.S. Pat. No. 3,744,963 specifically incorporated by reference herein, but with special gaseous flow entry ports 11. Burner assembly 10 is supplied with a mixture of gaseous fuel and air or other oxidizing gas from conventional air and gas sources. The burner combustion produces the heat required to render the nozzle block irridescent, this temperature usually being approximately 2000 degrees F. These discharge ports are at an acute angle to the plane of the elongated burner outlet so as to merge with the burner gases, specifically at the precise angle of 60 degrees plus or minus 5 degrees, relative to the central plane of flow from the burner through the outlet thereof (see phantom line in FIG. 4). This discharge angle has been found to result in thorough mixture of the solvents and injected combustible pollutants within the combustion chamber of the laterally elongated burner nozzle block. This complete mixing and concurrent combustion of the solvents under pressure within the unique nozzle produces temperatures in excess of 2200 degrees F to incinerate the combustible substances. The incinerated gases flow at high velocity from the restricted nozzle discharge opening 30 (FIGS. 2 and 4). These gases are used to produce the required heat for the heat treatment section described as section 8.

Ambient air propelled by blower 20 and discharging from piping network 24 entrains heat from the combustion process, and mixes it thoroughly as disclosed in U.S. Pat. No. 3,358,979, whereupon it is used for the heat treatment process. This air is eventually drawn into ductwork 12 and propelled out to the atmosphere by fan and motor 14. The end result is that the air is relatively clean and free from harmful pollutants. Instead of hot gases being vented directly to the atmosphere through exhaust stacks as is conventionally done, such gases containing solvent vapors and other pollutants are thus specially processed, resulting in significant advantages. Specifically the warm gases emitted from pipes 24 in zone 1, the entry zone, force the combustible solvent volatiles to flash-off. This solvent laden air is then processed through the recycle ductwork and delivered to the previously described specially slanted discharge ports within the novel burner block. This insures kindling temperatures above 600 degrees F. for solvent incineration.

The introduction of controlled quantities of cool air through pipes 24 controllably lowers the temperature of the gases back down to drying range temperatures within section 8 (i.e. range 350 degrees F. to 400 degrees F.). The temperature is controlled by conventional and accepted means to the highest that is tolerable for the particular process, whether it be glue drying, adhesive bonding, coating, curing or the like. The temperature within the oven chamber 22 is sensed for control by a suitable high limit temperature sensor 32 such as a thermocouple projecting into the plenum. This regulates ambient air input to a rate to prevent the temperature from exceeding the maximum allowable for the particular product being processed.

The embodiment set forth in FIGS. 1 and 4 involves recirculation of solvent-laden air streams from section 6 to the combustion chamber of section 8, and into section 8, eventually being drawn into the exhaust stack of section 8 and subsequently discharged as generally clean effluent to the atmosphere.

Preferably air curtain units 23 and 24 are employed at the entrance to the first section and at the exit from the last section, these being for example of the type disclosed in more detail in U.S. Pat. No. 3,744,963 at 22 and 24. This helps to lessen hot gas flow out the inlet and exit.

The results of the invention are increased production and/or lower capital equipment costs and requirements, significantly greater heat conservation with less fuel consumption and pollution control. Another operational factor for flat coated stock is that the faster the product can effectively be advanced through it, the greater the efficiency. Using the invention, rates of feed can be increased by over 30% or more, yet with effective drying and heat treating, thereby further increasing efficiency and production output. It is also possible that a plurality of oven zones could increase benefits employed. Those skilled in this art, upon studying the disclosure and concept herein, will likely think of other variations of the illustrative embodiment set forth, to suit a particular application. The invention is intended to be limited only by the scope of the appended claims and the reasonable equivalents thereto.

The embodiments of the invention in which an exclusive property or privilege is claimed are defined as follows:

1. A solvent reducing drying oven comprising:

an elongated housing having product advancing means for conveying product therethrough to allow solvents to be driven off the product;

burner means with its discharge oriented into said oven for combusting solvents and supplying the resultant heat to said oven;

vaporized solvent ducting and advancing means from said housing for advancing vaporized combustible solvents from said housing, including passages into said burner means oriented at an acute angle toward and relative to the discharge outlet from said burner means for pressurized combustion of the solvents, and transfer of the resultant heat to said oven.

2. The oven in claim 1 wherein said acute angle is 60 degrees relative to said burner discharge outlet, plus or minus 5 degrees.

3. A solvent reducing drying oven comprising:

an elongated housing having product advancing means for conveying product therethrough to allow solvents to be driven off the product;

said housing having an entry section and an exit section;

said exit section including burner means for combusting solvents, fuel and oxidizing gas inlet means to said burner means, said burner means having an outlet nozzle with a discharge outlet; solvent flow passages into said burner discharge nozzle at an acute angle with respect to and toward said discharge outlet; and solvent ducting from said entry section to said passages in said burner nozzle to convey vaporized solvents to said burner for combustion of the solvents.

4. The oven in claim 3 wherein said acute angle is 60 degrees plus or minus 5 degrees.

5. The oven in claim 3 wherein said burner means and its said nozzle are laterally elongated.

6. The oven in claim 3 including ambient air inlet means in said exit section for lowering the temperature of gases therein.

* * * * *